US011604015B2

(12) United States Patent
Clara

(10) Patent No.: US 11,604,015 B2
(45) Date of Patent: Mar. 14, 2023

(54) MULTISTAGE, MICROCHANNEL CONDENSERS WITH DISPLACED MANIFOLDS FOR USE IN HVAC SYSTEMS

(71) Applicant: Lennox Industries Inc., Richardson, TX (US)

(72) Inventor: Colin Patrick Clara, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 275 days.

(21) Appl. No.: 16/997,911

(22) Filed: Aug. 19, 2020

(65) Prior Publication Data

US 2020/0378660 A1 Dec. 3, 2020

Related U.S. Application Data

(62) Division of application No. 15/954,589, filed on Apr. 16, 2018, now abandoned.

(Continued)

(51) Int. Cl.
*F25B 39/00* (2006.01)
*F25B 7/00* (2006.01)

(Continued)

(52) U.S. Cl.
CPC ..... *F25B 39/00* (2013.01); *F25B 7/00* (2013.01); *F25B 39/04* (2013.01); *F28D 1/0417* (2013.01);

(Continued)

(58) Field of Classification Search
CPC ..... F25B 7/00; F25B 2400/06; F25B 39/04; F28D 1/0417; F28D 2021/0063;

(Continued)

(56) References Cited

U.S. PATENT DOCUMENTS 5,099,576 A † 3/1992 Shinmura
2011/0056667 A1* 3/2011 Taras ..... F28D 1/0426 165/173

(Continued)

FOREIGN PATENT DOCUMENTS

| | | | |
|---|---|---|---|
| EP | 2810010 | A2 | 12/2014 |
| JP | H05272882 | A | 10/1993 |
| WO | 2013116178 | A2 | 8/2013 |

OTHER PUBLICATIONS

Decision to Grant European Patent received in European Application No. 18167834.3, dated Jan. 30, 2020.

(Continued)

*Primary Examiner* — Elizabeth J Martin
(74) *Attorney, Agent, or Firm* — Johnston IP Law, PLLC

(57) ABSTRACT

In one instance, a multistage microchannel condenser is provided for use as an aspect of a heating, ventilating, and air conditioning (HVAC) system. The multistage microchannel condenser includes at least two pluralities of flat tubes having microchannels, each associated with a different refrigeration circuit, that are interspersed so that when only one refrigeration circuit is operational, the multistage microchannel condenser still does not have any substantial thermal dead spots. Manifolds are used on each end of the multistage microchannel condenser to fluidly couple members of the at least two pluralities of flat tubes such that the refrigerant in each refrigeration circuit remains separated while still using a majority of the area of the face of the multistage microchannel condenser. Other aspects are presented.

9 Claims, 11 Drawing Sheets

Related U.S. Application Data

(60) Provisional application No. 62/486,415, filed on Apr. 17, 2017, provisional application No. 62/486,413, filed on Apr. 17, 2017.

(51) Int. Cl.

| | |
|---|---|
| ***F28F 1/02*** | (2006.01) |
| ***F25B 39/04*** | (2006.01) |
| ***F28F 9/02*** | (2006.01) |
| ***F28D 1/04*** | (2006.01) |
| ***F28F 1/12*** | (2006.01) |
| ***F28D 1/053*** | (2006.01) |
| ***F28D 21/00*** | (2006.01) |

(52) U.S. Cl.

CPC ..... *F28D 1/0426* (2013.01); *F28D 1/05391* (2013.01); *F28F 1/022* (2013.01); *F28F 1/126* (2013.01); *F28F 9/0202* (2013.01); *F28F 9/0204* (2013.01); *F28F 9/0229* (2013.01); *F25B 2400/06* (2013.01); *F28D 2021/0084* (2013.01); *F28F 2009/0287* (2013.01); *F28F 2260/02* (2013.01)

(58) Field of Classification Search

CPC ..... F28D 1/05391; F28F 9/02; F28F 9/0202; F28F 9/0229; F28F 1/02; F28F 1/12; F28F 1/022; F28F 9/0204; F28F 2009/0297; F28F 9/0212

See application file for complete search history.

(56) References Cited

U.S. PATENT DOCUMENTS

| | | | | |
|---|---|---|---|---|
| 2012/0011867 | A1* | 1/2012 | Koons ..... | F28D 1/0443 165/165 |
| 2012/0111034 | A1 | 5/2012 | Campbell et al. | |
| 2012/0111035 | A1 | 5/2012 | Campbell et al. | |

OTHER PUBLICATIONS

European Search Report received in European Application No. 18167834.3, dated Nov. 11, 2018.

* cited by examiner
† cited by third party

MULTISTAGE, MICROCHANNEL CONDENSERS WITH DISPLACED MANIFOLDS FOR USE IN HVAC SYSTEMS

CROSS-REFERENCE TO RELATED APPLICATIONS

This application is a divisional of U.S. application Ser. No. 15/954,589 filed Apr. 16, 2018, which claims priority to and the benefit of U.S. Provisional Application Ser. No. 62/486,415, titled, "Multistage, Microchannel Condensers with Laterally Displaced Manifolds for Use in HVAC Systems," filed Apr. 17, 2017 and U.S. Provisional Application Ser. No. 62/486,413, titled, "Multistage, Microchannel Condensers with Longitudinally Displaced Manifolds for Use in HVAC Systems," filed Apr. 17, 2017, all of which are incorporated herein for all purposes.

TECHNICAL FIELD

This application is directed, in general, to heating, ventilating, and air conditioning (HVAC) systems, and more specifically, to multistage, microchannel condensers with displaced manifolds.

BACKGROUND

Heating, ventilating, and air conditioning (HVAC) systems can be used to regulate the environment within an enclosed space. Typically, an air blower is used to pull air (i.e., return air) from the enclosed space into the HVAC system through ducts and push the air into the enclosed space through additional ducts after conditioning the air (e.g., heating, cooling or dehumidifying the air). Unless otherwise indicated, as used throughout this document, "or" does not require mutual exclusivity. Various types of HVAC systems may be used to provide conditioned air for enclosed spaces.

These HVAC systems include a number of heat exchangers, notably one or more condensers. The HVAC systems may take a variety of sizes and styles including small residential units and large-scale roof-top units for commercial applications. In the typical HVAC system, the one or more condensers receive compressed, gaseous refrigerant from one or more compressors and condense the refrigerant into liquid form. The condenser discharges compressed, liquid refrigerant, which is then delivered to one or more evaporators to cool air to be provided to the building. The liquid refrigerant is evaporated as it passes through the evaporator producing the gaseous refrigerant that is delivered to one or more compressors to produce a compressed gas refrigerant that is delivered to the one or more condensers.

Because the HVAC systems require a significant use of energy for building operators, improvements remain desirable in the systems and in the heat exchangers including the condensers.

SUMMARY

According to an illustrative embodiment, a heating, ventilating, and air conditioning (HVAC) system includes at least two closed refrigerant circuits and a multistage microchannel condenser fluidly coupled to both. The multistage microchannel condenser includes at least two pluralities of flat tubes interspersed in an exchange area. The system includes a first first-end manifold having long dimension at a right angle to a long dimension of the at least two pluralities of flat tubes and wherein the first first-end manifold is disposed proximate a first end of the multistage microchannel condenser and a second first-end manifold having long dimension at a right angle to a long dimension of the at least two pluralities of flat tubes and wherein the second first-end manifold is disposed proximate a first end of the multistage microchannel condenser. The system further includes a first second-end manifold having long dimension at a right angle to the long dimension of the at least two pluralities of flat tubes and wherein the first second-end manifold is disposed proximate a second end of the multistage microchannel condenser and a second second-end manifold having long dimension at a right angle to the long dimension of the at least two pluralities of flat tubes and wherein the second second-end manifold is disposed proximate a second end of the multistage microchannel condenser. The first end of the first plurality of flat tubes is fluidly coupled to the first first-end manifold and the second end of the first plurality of flat tubes is fluidly coupled to the first second-end manifold. The first end of the second plurality of flat tubes is fluidly coupled to the second first-end manifold and the second end of the second plurality of flat tubes is fluidly coupled to the second second-end manifold. In one version, wherein the first first-end manifold and the second first-end manifold are longitudinally displaced from one another in a direction parallel to the long dimension of the two pluralities of flat tubes. In another version, the first first-end manifold and the second first-end manifold are laterally displaced from one another in a direction orthogonal to the long dimension of the two pluralities of flat tubes and substantially adjacent to one another with respect to the direction of the long dimension of the two pluralities of flat tubes.

According on an illustrative embodiment, a heating, ventilating, and air conditioning (HVAC) system includes a first closed refrigeration circuit and a second closed refrigeration circuit both fluidly coupled to a condenser. The condenser comprises a multistage microchannel condenser having an exchange profile with an exchange area. The system further includes a condenser blower for producing a condenser airflow across the multistage microchannel condenser.

The multistage microchannel condenser includes a first plurality of flat tubes having a first end and a second end. The first plurality of flat tubes is for receiving and transporting the first refrigerant. Each flat tube of the first plurality of flat tubes has a plurality of microchannels and is in fluid communication with the first closed refrigeration circuit. The first plurality of flat tubes extends in a first, longitudinal direction. The microchannel condenser also includes a second plurality of flat tubes having a first end and a second end. The second plurality of flat tubes is for receiving and transporting the second refrigerant. Each flat tube of the second plurality of flat tubes has a plurality of microchannels and is in fluid communication with the second closed refrigeration circuit. The second plurality of flat tubes also extends in the first, longitudinal direction. At least a portion of the first plurality of flat tubes is interspersed with at least a portion of the second plurality of flat tubes throughout at least a majority of the exchange area.

The multistage microchannel condenser also includes a first manifold fluidly coupled to the first plurality of flat tubes at the first end of the first plurality of flat tubes. The first manifold extends in a second, vertical direction that is substantially orthogonal to the first, longitudinal direction. The multistage microchannel condenser also has a second manifold fluidly coupled to the first plurality of flat tubes at the second end of the first plurality of flat tubes and extending in the second, vertical direction. The multistage microchannel condenser further includes a third manifold fluidly coupled to the second plurality of flat tubes at the first end of the second plurality of flat tubes. The third manifold extends in the second, vertical direction. The multistage microchannel condenser further includes a fourth manifold fluidly coupled to the second plurality of flat tubes at the second end of the second plurality of flat tubes. The fourth manifold extends in the second, vertical direction. The first manifold and third manifold are parallel to one another and displaced from one another along a third, lateral direction substantially orthogonal to the first direction and second direction.

According to another illustrative embodiment, a heating, ventilating, and air conditioning (HVAC) system includes at least two closed refrigerant circuits and a multistage microchannel condenser having an exchange area and having at least two pluralities of flat tubes interspersed in the exchange area. The at least two closed refrigerant circuits are fluidly coupled to the multistage microchannel condenser. The system also includes at least two manifolds at a first longitudinal end of the at least two pluralities of flat tubes and on a first end of the multistage microchannel condenser. The at least two manifolds at the first longitudinal end are laterally displaced from one another in a direction orthogonal to a length of the two pluralities of flat tubes. The system also includes at least two manifolds at a second longitudinal end of the at least two pluralities of flat tubes and on a second end of the multistage microchannel condenser. The at least two manifolds at the second longitudinal end are laterally displaced from one another in a direction orthogonal to the length of the two pluralities of flat tubes According to another illustrative embodiment, a multistage microchannel condenser for use in a heating, ventilating, and air conditioning (HVAC) system includes a first plurality of flat tubes and a second plurality of flat tubes. The first plurality of flat tubes has a first end and a second end. The first plurality of flat tubes is for receiving and transporting the first refrigerant. Each flat tube of the first plurality of flat tubes and second plurality of flat tubes has a plurality of microchannels. The first plurality of flat tubes is in fluid communication with the first closed refrigeration circuit, and the first plurality of flat tubes extending in a first, longitudinal direction. Likewise, the second plurality of flat tubes has a first end and a second end. The second plurality of flat tubes is for receiving and transporting the second refrigerant and is in fluid communication with the second closed refrigeration circuit. The second plurality of flat tubes also extends in the first, longitudinal direction. At least a portion of the first plurality of flat tubes is interspersed with at least a portion of the second plurality of flat tubes throughout at least a majority of the exchange area.

The multistage microchannel also includes a first manifold fluidly coupled to the first plurality of flat tubes at the first end of the first plurality of flat tubes. The first manifold extends, with respect to its long dimension, in a second, vertical direction that is substantially orthogonal to the first, longitudinal direction. The multistage microchannel also has a second manifold fluidly coupled to the first plurality of flat tubes at the second end of the first plurality of flat tubes and that extends with respect to its long dimension in the second, vertical direction. The multistage microchannel further includes a third manifold fluidly coupled to the second plurality of flat tubes at the first end of the second plurality of flat tubes and the third manifold extends with respect to its long dimension in the second, vertical direction. The multistage microchannel also has a fourth manifold fluidly coupled to the second plurality of flat tubes at the second end of the second plurality of flat tubes and the fourth manifold extends with respect to its long dimension in the second, vertical direction. The first manifold and third manifold are parallel to one another and displaced from one another along a third, lateral direction substantially orthogonal to the first direction and second direction.

According on an illustrative embodiment, a heating, ventilating, and air conditioning (HVAC) system includes a first closed refrigeration circuit and a second closed refrigeration circuit both fluidly coupled to a condenser. The condenser comprises a multistage microchannel condenser having an exchange profile with an exchange area. The system further includes a condenser blower for producing a condenser airflow across the multistage microchannel condenser.

The multistage microchannel condenser includes a first plurality of flat tubes having a first end and a second end. The first plurality of flat tubes is for receiving and transporting the first refrigerant. Each flat tube of the first plurality of flat tubes has a plurality of microchannels and is in fluid communication with the first closed refrigeration circuit. The first plurality of flat tubes extends in a first, longitudinal direction. The microchannel condenser also includes a second plurality of flat tubes having a first end and a second end. The second plurality of flat tubes is for receiving and transporting the second refrigerant. Each flat tube of the second plurality of flat tubes has a plurality of microchannels and is in fluid communication with the second closed refrigeration circuit. The second plurality of flat tubes also extends in the first, longitudinal direction. At least a portion of the first plurality of flat tubes is interspersed with at least a portion of the second plurality of flat tubes throughout at least a majority of the exchange area.

The multistage microchannel condenser also includes a first manifold fluidly coupled to the first plurality of flat tubes at the first end of the first plurality of flat tubes and that extends, with respect to its long dimension, in a second direction that is substantially orthogonal to the first direction. The multistage microchannel condenser further includes a second manifold fluidly coupled to the first plurality of flat tubes at the second end of the first plurality of flat tubes and extending with respect to its long dimension in the second direction and a third manifold fluidly coupled to the second plurality of flat tubes at the first end of the second plurality of flat tubes and that extends with respect to its long dimension in a second direction that is substantially orthogonal to the first direction. The multistage microchannel condenser also includes a fourth manifold fluidly coupled to the second plurality of flat tubes at the second end of the second plurality of flat tubes and the fourth manifold extending with respect to its long dimension in the second direction. The first manifold and third manifold are parallel to one another and displaced from one another with respect to the first direction. At least a portion of the first plurality of flat tubes extends through the third manifold.

According to still another illustrative embodiment, a multistage microchannel condenser for use in a heating, ventilating, and air conditioning (HVAC) system includes a first plurality of flat tubes having a first end and a second end. The first plurality of flat tubes is for receiving and transporting a first refrigerant. Each flat tube of the first plurality of flat tubes has a plurality of microchannels. The first plurality of flat tubes extends, with respect to its long dimension, in a first direction. The multistage microchannel condenser also includes a second plurality of flat tubes having a first end and a second end. The second plurality of flat tubes is for receiving and transporting a second refrigerant. Again, each flat tube of the second plurality of flat tubes has a plurality of microchannels. The second plurality of flat tubes extends in the first direction. At least a portion of the first plurality of flat tubes is interspersed with at least a portion of the second plurality of flat tubes throughout at least a majority of an exchange area of a front face of the multistage microchannel condenser.

The multistage microchannel condenser also has a first manifold fluidly coupled to the first plurality of flat tubes at the first end of the first plurality of flat tubes. The first manifold extends, with respect to its long dimension, in a second direction that is substantially orthogonal to the first direction. The multistage microchannel condenser further includes a second manifold fluidly coupled to the first plurality of flat tubes at the second end of the first plurality of flat tubes. The second manifold extends, with respect to its long dimension, in the second direction. The multistage microchannel condenser also has a third manifold fluidly coupled to the second plurality of flat tubes at the first end of the second plurality of flat tubes. The third manifold extends, with respect to its long dimension, in the second direction that is substantially orthogonal to the first direction. The multistage microchannel condenser has a fourth manifold fluidly coupled to the second plurality of flat tubes at the second end of the second plurality of flat tubes. The fourth manifold extends, with respect to its long dimension, in the second direction. The first manifold and third manifold are parallel to one another and are displaced from one another with respect to the first direction. At least a portion of the first plurality of flat tubes extends through the third manifold. Still other embodiments are presented herein.

DESCRIPTION OF THE DRAWINGS

Illustrative embodiments of the present disclosure are described in detail below with reference to the attached drawing figures, which are incorporated by reference herein and wherein.

DETAILED DESCRIPTION

Figure 1:
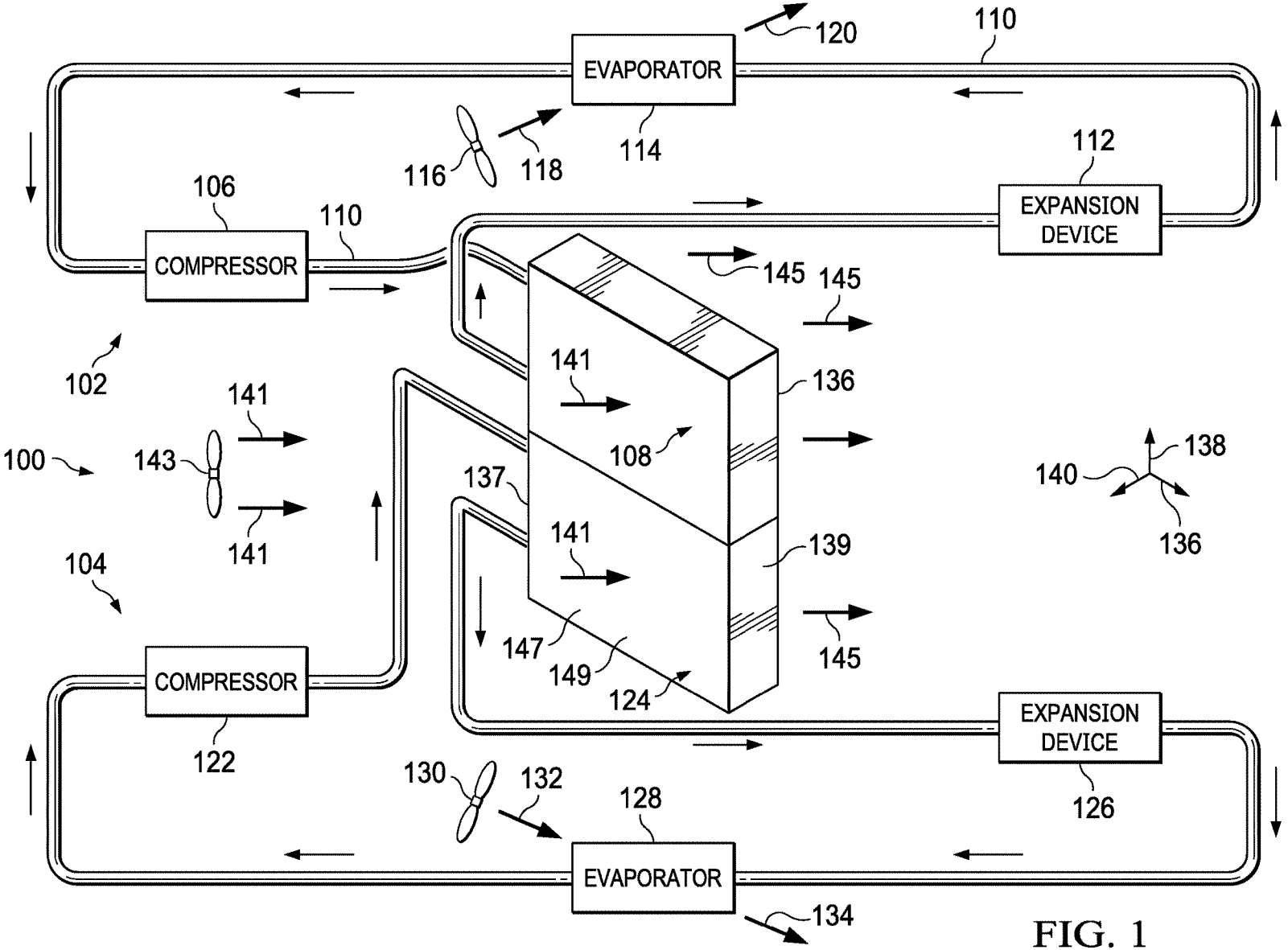
FIG. 1 is a schematic diagram with a portion shown as a perspective of an HVAC system having a multistage, microchannel condenser.

Referring now to the drawings and initially to FIG. 1, heating, ventilating, and air conditioning (HVAC) system 100 is shown having a first closed refrigeration circuit 102 and a second closed refrigeration circuit 104. While only two closed refrigeration circuits are shown, it should be understood that any number of circuits might be included albeit the disclosure contemplates at least two. The first closed refrigeration circuit 102 includes a first compressor 106 that produces a high pressure gaseous refrigerant that is delivered to a first condenser 108 through a portion (discharge line) of a first plurality of fluid conduits 110. The first condenser 108 is a multistage, microchannel condenser as will be described further below.

The first condenser 108 produces a high pressure liquid refrigerant that is delivered through a portion (liquid line) of the first closed refrigeration circuit 102 to a first expansion device 112, or metering device. The first expansion device 112 produces a low pressure liquid refrigerant that is delivered through a portion of the first closed refrigeration circuit 102 to a first evaporator 114. A first blower 116 moves air 118 across the first evaporator 114 to produce conditioned air 120, which may be delivered to a climate-controlled environment. In the process of cooling the air 118, the refrigerant becomes a low-pressure gas that is delivered to the first compressor 106 through a portion (suction line) of the first closed refrigeration circuit 102. The cycle repeats, as it is a closed circuit.

The second closed refrigeration circuit 104 is analogous to the first closed refrigeration circuit 102. Thus, the second closed refrigeration circuit 104 includes a second compressor 122 fluidly coupled to a second condenser 124. The first condenser 108 and the second condenser 124 form the same multi-stage condensing unit as will be explained further below. The second closed refrigeration circuit 104 also includes a second expansion device 126, a second evaporator 128, and a second blower 130. The second blower 130 moves a second airflow 132 to be treated across the evaporator 128 to produce a second conditioned air 134.

The first condenser 108 and the second condenser 124 comprise condenser unit 135 that is a microchannel condenser and in the preferred embodiment is a multistage microchannel condenser having portions of at least two interspersed closed refrigeration circuits, e.g., closed refrigeration circuits 102 and 104, involved. For reference purposes, the condenser unit 135 extends in a first direction 136 (or longitudinal direction), a second direction 138 (or vertical direction for the orientation shown), and third direction 140 (or lateral direction). The directions 136, 138, 140, or axes, are orthogonal to one another and are for reference. The condenser unit 135 has a first side 137 and a second side 139. As described with various permutations further below, the first side 137 may include one or more intake manifolds and the second side 139 may include one or more outlet manifolds.

Condenser cooling air 141 may be moved by a condenser blower 143 across the condenser unit 135 to remove heat from the condenser 135. The cooling air 141 impacts a front face 147 of the condenser unit 135. A discharge airflow 145 leaves the condenser 135 with the rejected heat. The cooling air 141 flows across substantially the entire condenser exchange profile, or exchange area 149. The exchange area 149 is the area of the condenser where heat is exchanged between the condenser and the cooling air 141.

Figure 2:
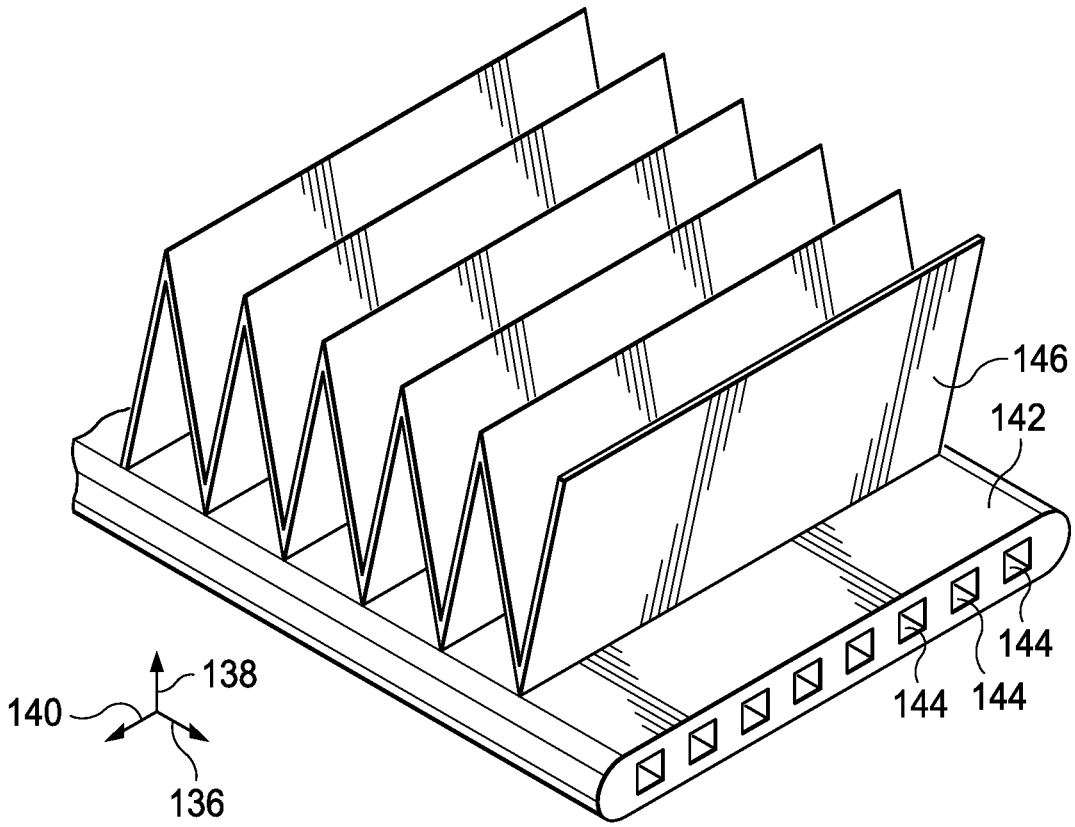
FIG. 2 is a schematic, perspective view of a portion of a flat tube having microchannels and fins.

Referring now primarily to FIG. 2, constituent components of the condenser unit 135 include pluralities of flat tubes 142 supported by a frame (not explicitly shown). The flat tubes 142 include a plurality of microchannels 144, or passageways. The microchannels 144 are for transporting refrigerant through the condenser unit 135. The microchannels 144 are much smaller in size than the conduits of a conventional fin-and-tube condenser coil. A plurality of fins 146, or fin member, may be coupled to a portion of each flat tube 142. The fins 146 are shown making a zig-zag pattern but other patterns might be used as well. The microchannels 144 are shown with rectangular cross-sections but other shapes are possible, e.g., circular, rectilinear, etc. Eight microchannels 144 are shown through the illustrative flat tube 142, but the number may vary for different applications. The plurality of flat tubes 142 may be extruded from aluminum or other suitable materials. Those skilled in the art will know that the flat tubes 142 are generally flat in appearance but do have a thickness to accommodate the microchannels and the flat tubes could vary some in shape.

Figure 3:
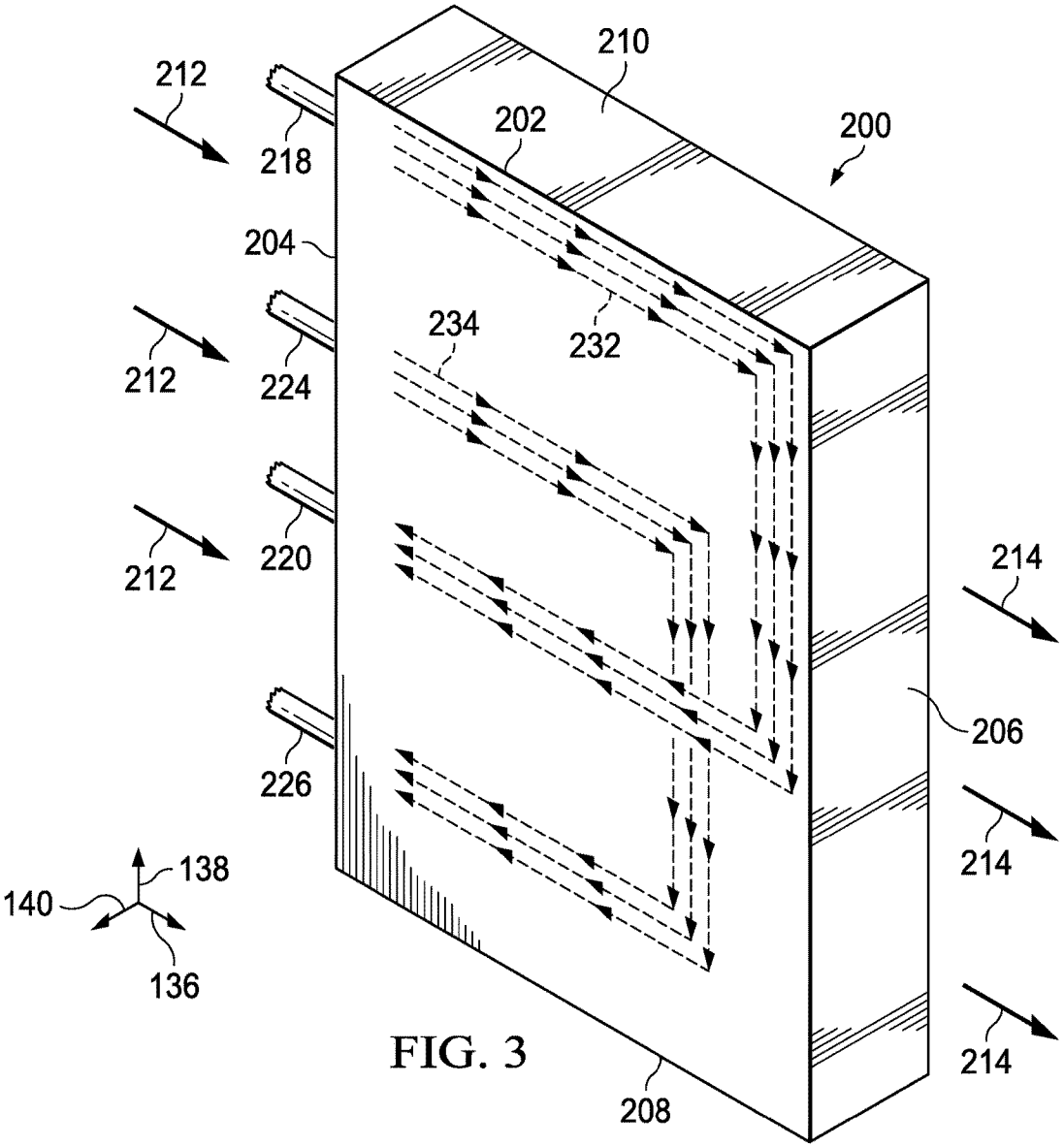
FIG. 3 is schematic diagram of a multistage, microchannel condenser with interspersed flat tubes associated with two different closed refrigeration circuits.

Referring now primarily to FIG. 3, an illustrative condenser unit 200, which may be used as condenser unit 135 in FIG. 1 in connection with the HVAC system 100, is presented. The condenser unit 200 has an exchange profile that would be substantially the front face as shown in the figure going from first side 204 to a second side 206 and from a bottom side 208 to a top side 210 for the orientation shown. Cooling air 212 from a condenser blower, e.g., 143 in FIG. 1, moves across substantially the entire exchange area and receives rejected heat and is discharged as discharge airflow 214. The airflow could be from a number of directions. In this embodiment, the HVAC system includes at least two closed interspersed refrigeration circuits (one entering at 218 and the other entering at 224). Compare and contrast this with FIG. 4 in which portions of those circuits are cooled in partitioned or segregated portions of the exchange area of the system. The system of FIG. 3 would be less efficient, compared to full load, in a partial load scenario when less than all circuits are operating and yet airflow 212 is delivered to all of the exchange area.

Figure 4:
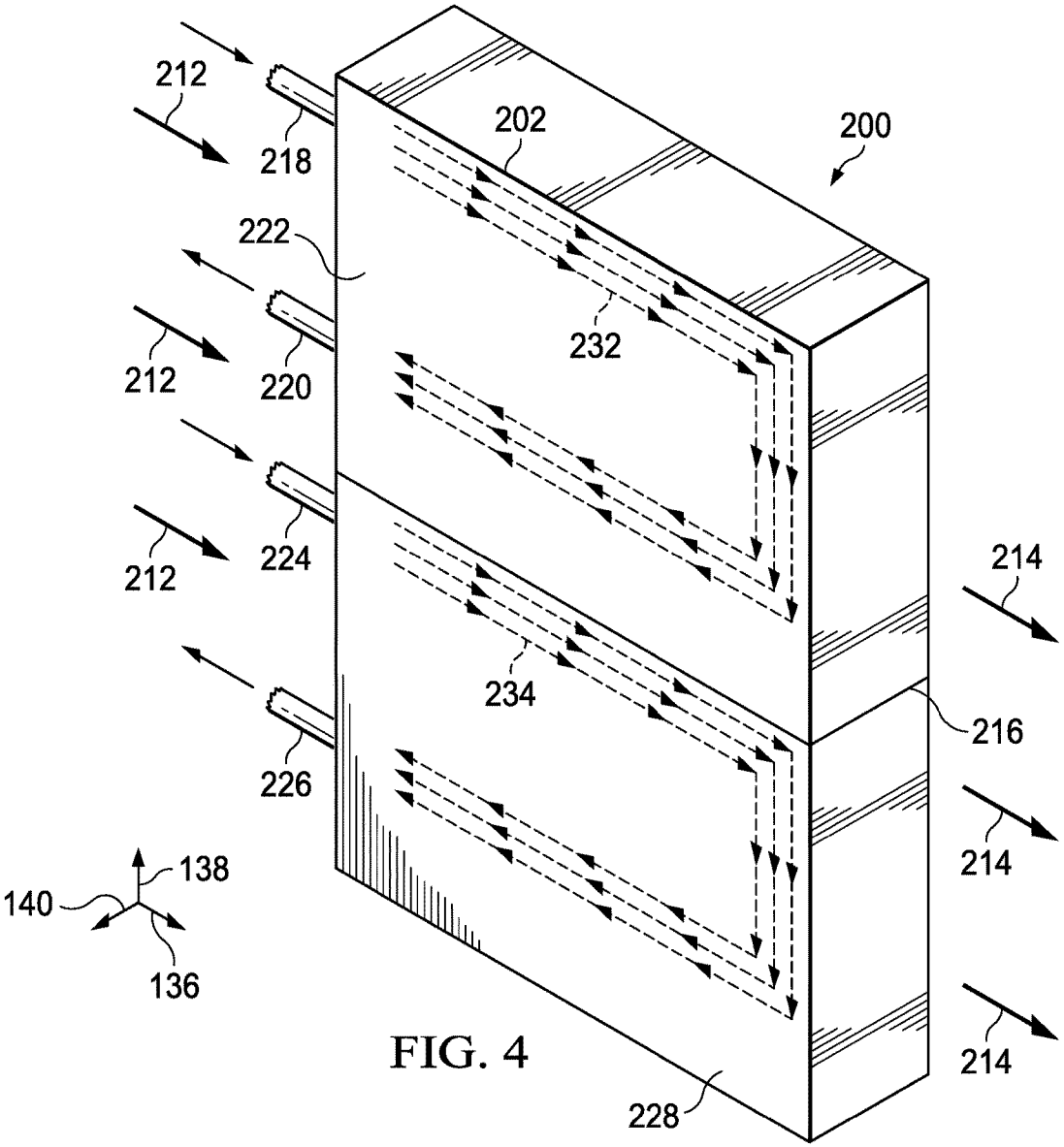
FIG. 4 is schematic diagram of a multistage, microchannel condenser with partitioned zones.

Referring now primarily to FIG. 4, another illustrative embodiment of a condenser unit 200 is presented. The scenario shown in FIG. 4, where the condenser unit 200 is shown for illustrative purposes as partitioned about line 216, is also less efficient at partial load than the condensers presented further below. Refrigerant enters in inlet 218 from the first circuit and exits an outlet 220 while remaining within a first partitioned portion 222 of the exchange profile (upper half of exchange area as shown). Similarly, refrigerant from a second circuit enters an inlet 224 and exits an outlet 226 after traversing microchannels (not explicitly shown but analogous to those in FIG. 2) in a second partitioned portion 228 (lower half of exchange area as shown). It will be appreciated that when only a partial load is needed, the second circuit (or alternatively the first circuit) may be turned off such that only refrigerant in the first circuit is moved through the condenser unit 200, but air 212 continues to be delivered to the entire exchange area including the non-active portion of the condenser unit 200 with respect its front face 202. As such, there is an inefficiency because of the ineffective area of the second partitioned portion 228. In contrast, the condenser 200 of FIG. 3 intersperses multiple circuits throughout the exchange area so that there are no partitioned portions, and accordingly, efficiencies are gained during partial load operation as compared to the condenser arrangement in FIG. 4.

Returning again to FIG. 3, refrigerant from a first circuit enters through inlet 218 and traverses through a microchannel pathway 232 to outlet 220. Refrigerant from a second circuit enters through inlet 224 and traverses through a microchannel pathway 234 through the exchange area and exits at outlet 226. It will be appreciated that the microchannel pathways 232 and 234 are interspersed as figuratively shown. As used herein "interspersed" means that a combination pattern is formed such that the pathways of the refrigeration circuits in the condenser traverse the exchange area of the exchange profile without any large segregated portions or partitioned portions; typically this means an alternating or weaving pattern or variation pattern is formed with the flat tubes (see 142 in FIG. 2). FIG. 3 shows the pathways 232, 234 alternating in groups of three but other patterns are possible. Before presenting further details of illustrative embodiments of the condenser units, it should be pointed out that in addition to gaining efficiency at partial load, it is desirable to maintain the same footprint for the condenser unit; that is, while desiring an interspersed arrangement, it may also be desirable that the size of the footprint of the condenser unit remain substantially the same as a conventional design.

Figure 5:
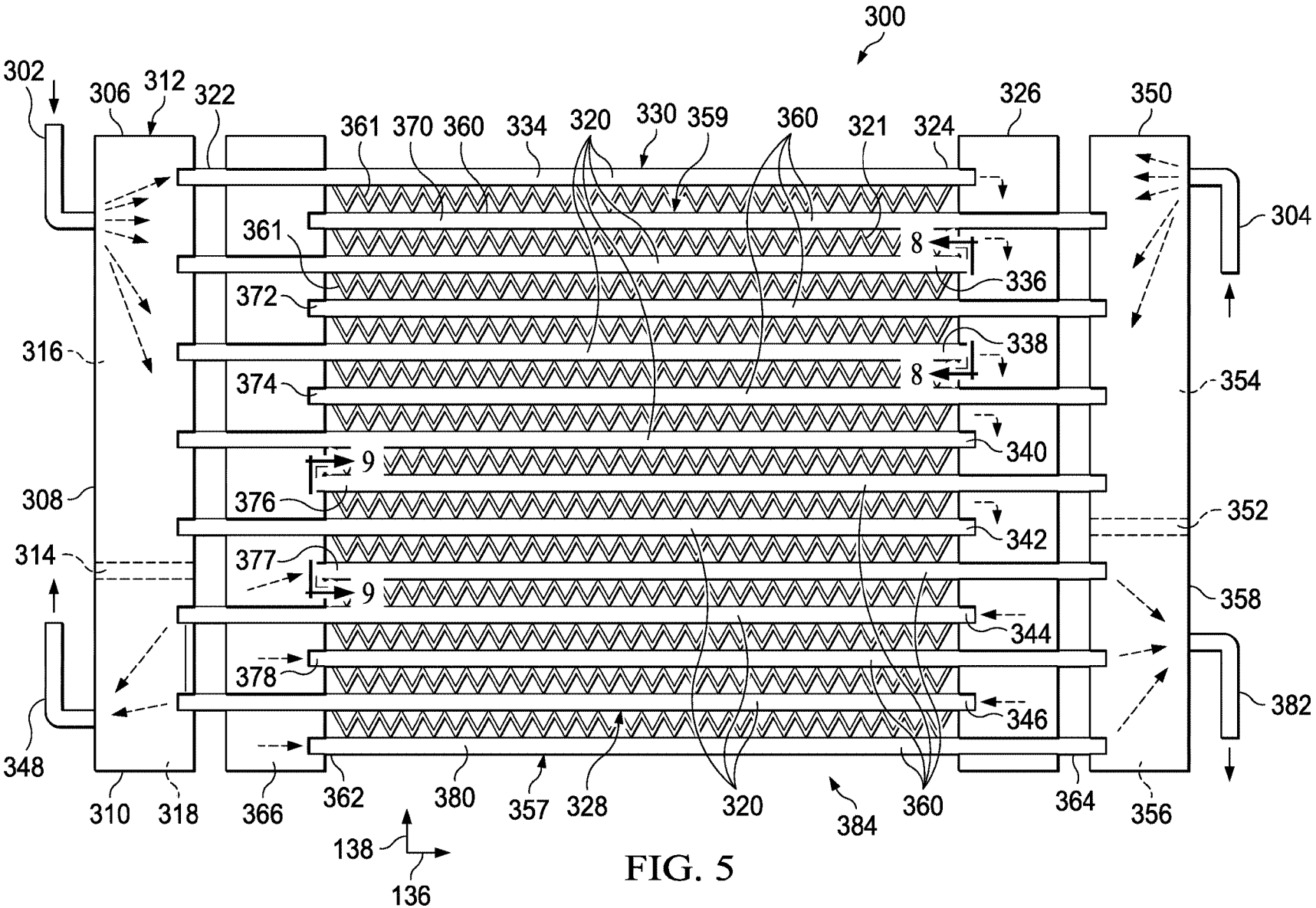
FIG. 5 is a schematic, front elevation view of an illustrative embodiment of a multistage, microchannel condenser.

Referring now primarily to FIGS. 5-11, and initially to FIG. 5, an illustrative embodiment of a multistage microchannel condenser 300 for use as part of an HVAC system is presented. As an aspect of a first closed refrigeration circuit (see, e.g., 102 in FIG. 1), a refrigerant is delivered to a first inlet 302 of the multistage microchannel condenser 300. Likewise, as an aspect of a second closed refrigeration circuit (see, e.g., 104 in FIG. 2), a refrigerant is delivered to a second inlet 304. While only two closed refrigeration circuits are described in connection with the multistage microchannel condenser 300 it should be understood that additional closed refrigeration circuits could be added consistent with the type of patterns presented. The pathways of the first closed refrigeration circuit through the multistage microchannel condenser 300 will be described first.

After entering the first inlet 302, the refrigerant is introduced into a first manifold 306 that is on a first end 308 of the multistage microchannel condenser 300. The first manifold 306 extends (in its long dimension) in the second direction 138 from a bottom 310 to a top 312 for the orientation shown. The first manifold 306 has a baffling member 314 defining a first chamber 316 (intake manifold) and a second chamber 318 (return manifold). A first plurality of flat tubes 320 having a first end 322 and a second end 324 is fluidly coupled to the first manifold 306. A plurality of fins 321 may be coupled to the first plurality of flat tubes 320. The fins 321 are shown on the top side (for the orientation shown) of the flat tubes 320 except the top most one. The first plurality of flat tubes 320 are for receiving and transporting the first refrigerant from the first closed refrigeration circuit. Each flat tube of the first plurality of flat tubes 320 has a plurality of microchannels (e.g., 144 in FIG. 2). The first plurality of flat tubes 320 extends (in its long dimension) in the first direction 136. The first plurality of flat tubes 320 is fluidly coupled to a second manifold 326. The second manifold 326 extends (in its long dimension) in the second direction 138. The first plurality of flat tubes 320 includes a bottom flat tube 328 and a top flat tube 330 for the orientation shown. A first outlet 348 is coupled to first manifold 306 at a lower portion (for orientation shown) for allowing the first refrigerant to exit the multistage microchannel condenser 300.

In operation of the multistage microchannel condenser 300 for the first refrigeration circuit according to one illustrative embodiment, the first refrigerant enters the first inlet 302 and is delivered into the first chamber 316 (intake manifold) of the first manifold 306 from where the first refrigerant is delivered to flat tubes 334, 336, 338, 340, and 342 of the first plurality of flat tubes 320. The first refrigerant traverses the flat tubes 334, 336, 338, 340, and 342 and is introduced into the second manifold 326 from where the first refrigerant is delivered to flat tubes 344 and 346 of the first plurality of flat tubes 320. The first refrigerant traverses the flat tubes 344 and 346 and is delivered into the second chamber 318 (return manifold) of the first manifold 306 from where it exits through first outlet 348 to continue in the first refrigeration circuit. It should be understood that the number of tubes included in the first plurality of flat tubes 320 is for illustration purposes and any number of tubes might be used.

As to the second pathway, a second refrigerant is introduced into the second inlet 304. The second inlet 304 is fluidly coupled to third manifold 350 having a baffling member 352 that defines a third chamber 354 (second intake manifold) and a fourth chamber 356 (second return manifold). The third manifold 350 defines a second end 358 of the multistage microchannel condenser 300. A second plurality of flat tubes 360 having a first end 362 and a second end 364 is fluidly coupled to the third manifold 350 at the second end 364. A plurality of fins 361 may be coupled to the second plurality of flat tubes 360 on a top side (for the orientation shown).

The second plurality of flat tubes 360 is for receiving and transporting the second refrigerant. Each flat tube of the second plurality of flat tubes 360 has a plurality of microchannels (e.g., 144 in FIG. 2) and is in fluid communication with the second closed refrigeration circuit. The second plurality of flat tubes 360 extends in the first direction 136 and runs substantially parallel to the first plurality of flat tubes 320. The second plurality of flat tubes includes a bottom flat tube 357 and a top flat tube 359 for the orientation shown. The second plurality of flat tubes 360 is fluidly coupled to a fourth manifold 366 (return manifold) at the first end 362 of the second plurality of flat tubes 360. A second outlet 382 is fluidly coupled to the fourth chamber 356 of the third manifold 350 for allowing the second refrigerant to exit the multistage microchannel condenser 300 and continue on in the second closed refrigeration circuit.

Thus, the second refrigerant is introduced into the multistage microchannel condenser 300 through second inlet 304 from where the second refrigerant is introduced into the third chamber 354 (intake manifold) of the third manifold 350. From there, the second refrigerant enters flat tubes 370, 372, 374, and 376 and traverses the second plurality of flat tubes 360 and is introduced into the fourth manifold 366. From there, the second refrigerant is delivered into flat tubes 378 and 380 and traverses the flat tubes 378 and 380 and is introduced into the fourth chamber 356 (return manifold) and exits second outlet 382. While flat tubes 334 and 380 are described as having channels and conducting flow, in some embodiments these exterior flat tubes may be for protection or solid or may be altered in other ways.

An exchange profile 384 is defined by the second manifold 326 on an interior edge, the fourth manifold 366 (left border for the orientation shown) on an interior edge, flat tube 380 (bottom border for the orientation shown) and flat tube 334 (top border for the orientation shown), and an exchange area is defined therein on the front face 391. It will be appreciated that at least a portion of the first plurality of flat tubes 320 is interspersed with at least a portion of the second plurality of flat tubes 360 throughout at least a majority of the exchange area. In this way, when the condenser fan (143 in FIG. 1) is on and the cooling air (141 in FIG. 1) impinges upon the exchange area there will be no "dead" thermal spots; that is heat exchange takes place to some degree throughout the majority of the exchange area in both full load and partial load modes of operation—the interspersed tube arrangement makes this possible. This is in contrast to the embodiment of FIG. 4 for which half of it was dead when in partial load.

Figure 6:
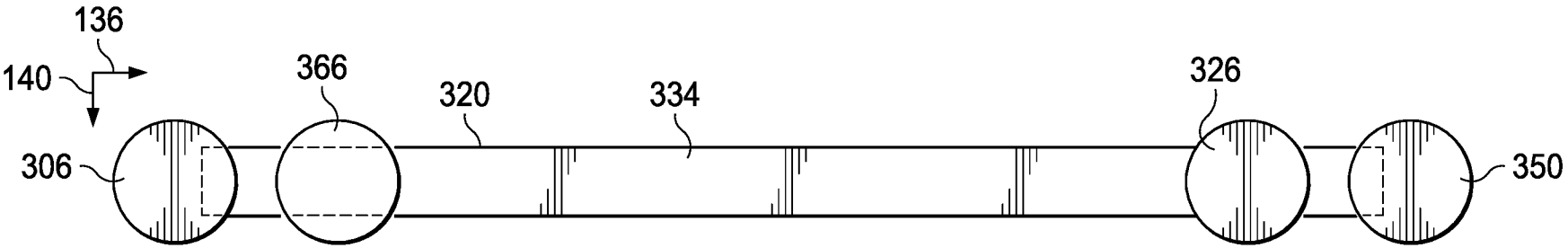
FIG. 6 is a top view of the multistage, microchannel condenser of FIG. 5.
Figure 7:
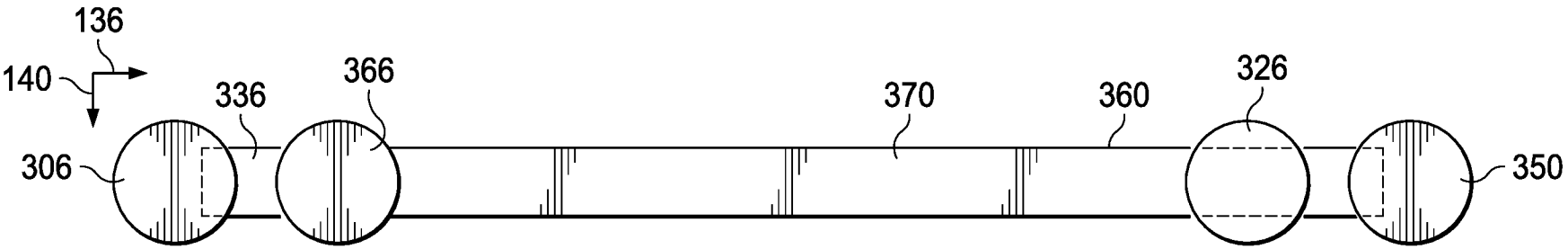
FIG. 7 is the same view as FIG. 6 with flat tube 334 removed.
Figure 9:
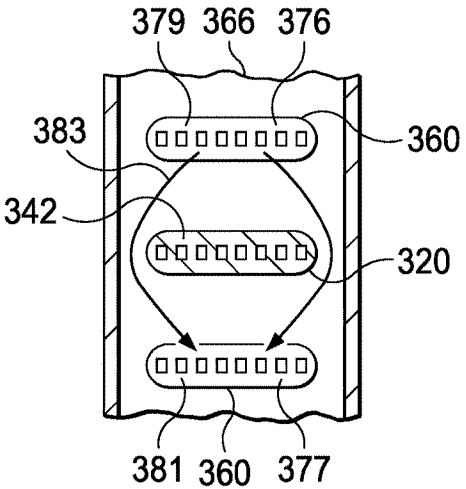
FIG. 9 is a schematic, cross sectional view of a portion of the multistage, microchannel condenser taken along line 9-9 in FIG. 5.

The manifolds 306, 326, 350, 366 are displaced from one another but on a line in the second direction 136, or longitudinally, as is clear from the top views FIGS. 6 and 7. FIG. 6 shows a top view of the multistage microchannel condenser 300 of FIG. 5. In this view one may see that the first plurality of flat tubes 320 extend through the fourth manifold 366. This is also shown, in part, in the partial cross-section of FIG. 9, which is taken along line 9-9 in FIG. 5. With references to FIGS. 5 and 9, distal ends 379, 381 of flat tubes 376 and 377, respectively, extend into the fourth manifold 366 such that fluid within the fourth manifold 366 may flow out of flat tube 376 and into flat tube 377 as suggested by arrows 383. Whereas the flat tube 342 of the first plurality of flat tubes 320 extends through the fourth manifold 366 as is thus shown in cross section in FIG. 9 and is isolated from the fluids within the fourth manifold 366.

Figure 8:
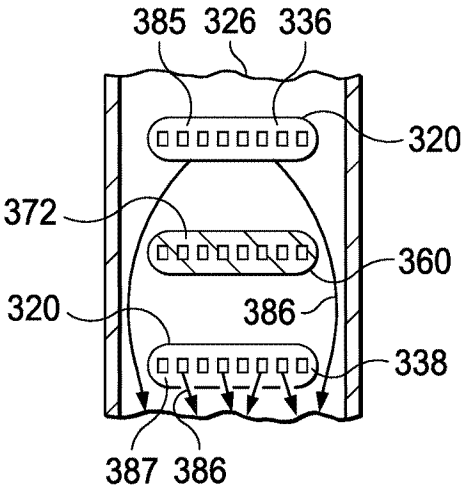
FIG. 8 is a schematic, cross sectional view of a portion of the multistage, microchannel condenser taken along line 8-8 in FIG. 5.

Referring now primarily to FIG. 7, a top view like that of FIG. 6, but with the flat tube 334 removed to expose flat tube 370 of the second plurality of flat tubes 360, is presented. It should be noted that the flat tubes of the first plurality of flat tubes 320 and the second plurality of flat tubes 360 may be of identical length for ease of manufacture, but other lengths and variations are possible. With reference now primarily to FIGS. 5, 7, and 8, one may see that the second plurality of flat tubes 360 (represented by flat tube 372) extend through the second manifold 326 (thus flat tube 373 is shown in cross section in FIG. 8) while remaining isolated from fluids in the second manifold 326. With reference now primarily to FIG. 8, distal ends 385, 387 of flat tubes 336 and 338, respectively, extend into the second manifold 326 such that the first refrigerant is delivered into the second manifold 326 and may move within the second as suggested by arrows 386 on its way to flat tubes 344 and 346. The flat tube 372 of the second plurality of flat tubes 360 extends through second manifold 326 but is isolated from fluids within the second manifold 326.

Figure 10:
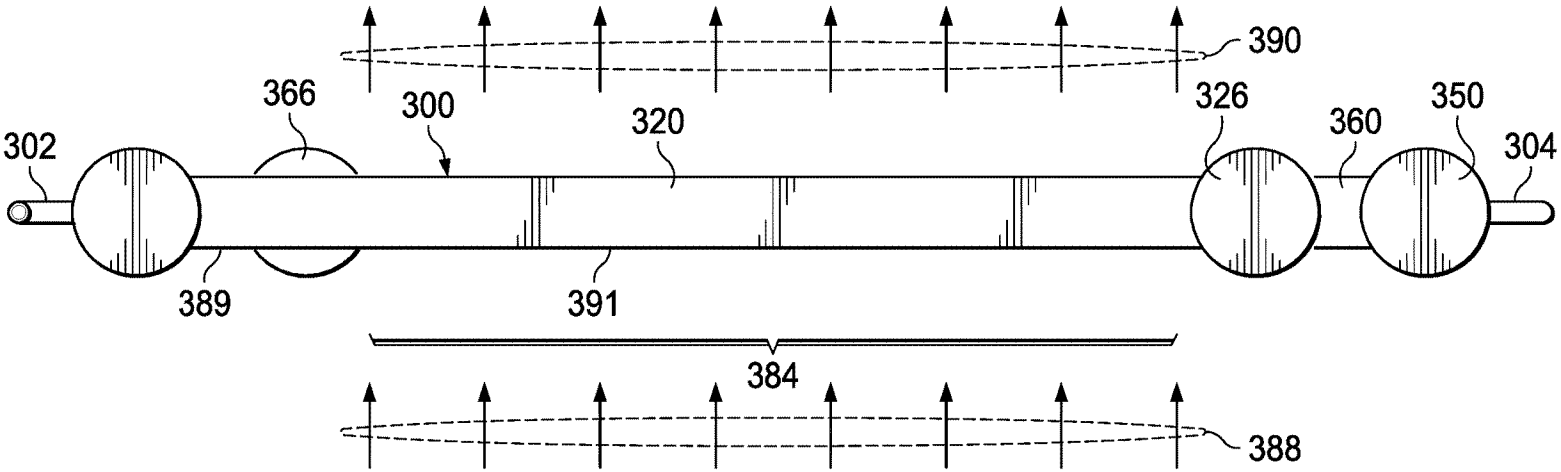
FIG. 10 is a schematic, top view of the multistage, microchannel condenser of FIG. 5 showing airflow across the multistage, microchannel condenser.
Figure 11:
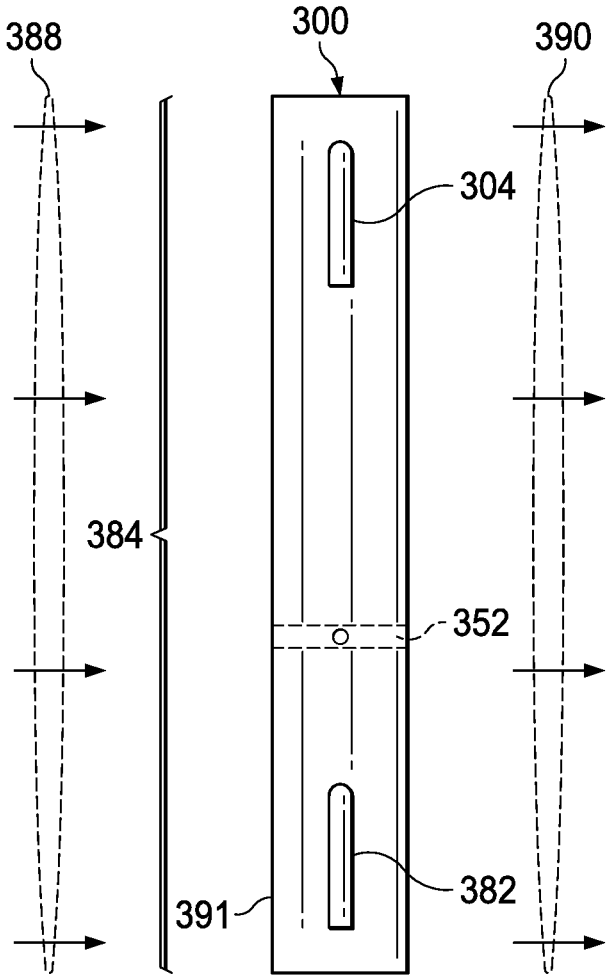
FIG. 11 is a schematic, side elevation view of the multistage, microchannel condenser of FIG. 5 showing airflow across the multistage, microchannel condenser.

Referring now primarily to FIG. 10, a schematic diagram of the multistage microchannel condenser 300 from the top showing cooling air 388 impinging upon the exchange profile 384 (longitudinal dimension shown) and exiting the multistage microchannel condenser 300 as discharge airflow 390 is presented. The cooling air 388 impinges on a front face 389 of the multistage microchannel condenser 300. Similarly, FIG. 11 shows a schematic diagram of a view of the multistage microchannel condenser 300. In this view, one may again see the cooling air 388 impinging upon the exchange profile 384 (vertical dimension shown) and exiting the multistage microchannel condenser 300 as discharge airflow 390.

In the illustrative embodiment of FIGS. 5-11, the flat tubes 320, 360 are shown as being substantially the same length. In another illustrative embodiment the flat tube lengths are of different lengths. In this alternative embodiment, the flat tubes 320 conveying refrigerant through the first pathway are longer than the flat tubes 360 conveying refrigerant through the second pathway. In such an embodiment, referring again primarily to FIG. 5, the flat tubes 320 would extend all the way through the second manifold 326 and terminate in the manifold 350. At the same time, the flat tubes 360 extend from the manifold 366 to the manifold 326 and terminate therein. Also, connecting tubes 304 and 382 are positioned in the manifold 326 rather than the manifold 350 as shown in FIG. 5. Additionally baffle 352 is located at the same vertical position (for orientation shown) but in the manifold 326 instead of the manifold 350. This embodiment may be desired when one wants all connecting tubes located at the same end of the coil. Here these connector tubes in the manifold 366 may need to be located at the top and bottom of the manifold 366, or out of the manifold in a direction out of the page. This embodiment may assist in manufacturing and assembly of the coil cores in some circumstances. This is done prior to placing the microchannel cores in the industrial manufacturing oven.

With reference to FIG. 5 again, it will appreciated that each of the first plurality of flat tubes and the second plurality of flat tubes have long dimensions (greatest dimension) that extend from the first ends to the second ends, i.e., direction 136, which longitudinal in this context. The manifolds 306, 326, 350, and 366 have long dimensions that extend in direction 138. The lateral direction is out of the page and is orthogonal to both directions 136 and 138.

In the illustrative embodiments of FIGS. 5-11 the manifolds 306, 326, 350, and 366 were displaced longitudinally (or along direction 136) from one another but providing for the interspersed flat tubes 320, 360 from two closed refrigeration circuits. Turning now primarily to FIGS. 12-18, the illustrative embodiments include manifolds that are displaced laterally (out of page in FIG. 5; 140 in FIG. 2) from one another but still allowing for interspersed flat tubes from two closed refrigeration circuits over the exchange area. In some embodiments, both approaches maintain a footprint for the condenser that is not substantially increased from that of a condenser that accommodates only one refrigerant circuit.

Figure 12:
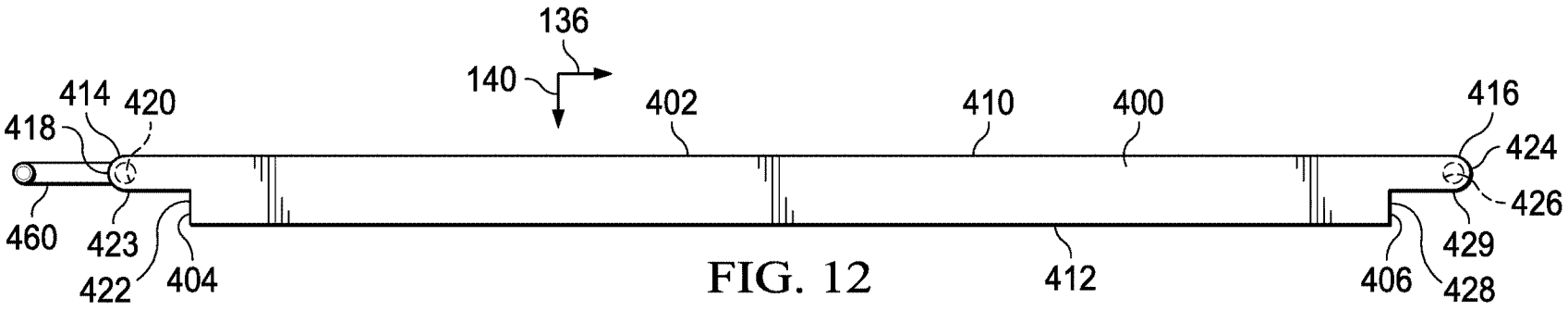
FIG. 12 is a schematic, top view of a flat tube according to another illustrative embodiment.

Referring now primarily to FIG. 12, a first flat tube 400 of a first plurality of flat tubes 402 (FIG. 15) is shown having a first end 404 and a second end 406. The flat tube 400 has a first longitudinal edge 410 and a second longitudinal edge 412. The flat tube 400 is shown with a first manifold 414 proximate first end 404 and a second manifold 416 proximate second end 406. The flat tube 400 has a plurality of microchannels or passageways (see, e.g., 144 in FIG. 2) that allow the refrigerant to be moved longitudinally (direction 136) through the flat tube 400. A first distal end 418 is in fluid communication with a first chamber 420 of the first manifold 414 to allow refrigerant to pass into or from the first chamber 420.

A first stepped portion 422 is formed on the first end 404 to provide a space for another laterally adjacent manifold to be placed as will be described further below. Outboard of the first stepped portion 422 is a first manifold extension portion 423. The other end of the flat tube 400 is shown with a second distal end 424 in fluid communication with a chamber 426 of the second manifold 416 to allow refrigerant to flow into or out of the chamber 426. A second stepped portion 428 is formed on the second end 406 to provide space for another laterally adjacent manifold to be placed as will be described further below. Outboard of the second stepped portion 428 is a second manifold extension portion 429.

Figure 13:
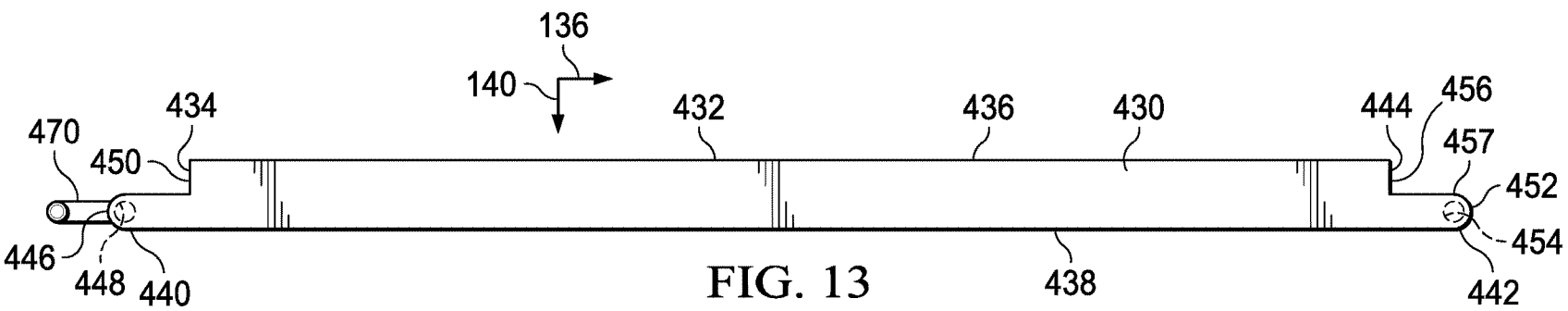
FIG. 13 is a schematic, top view of a flat tube made to coordinate with the flat tube of FIG. 12.

Referring now primarily to FIG. 13, a second flat tube 430 of a second plurality of flat tubes 432 (FIG. 15) is presented. The second flat tube 430 is analogous to the first flat tube 400 except that it is flipped. This provides for easier manufacture. The flat tube 430 has a first longitudinal edge 436 and a second longitudinal edge 438. The second flat tube 430 is shown with a third manifold 440 proximate to a first end 434 and a fourth manifold 442 proximate a second end 444. The flat tube 430 has a plurality of microchannels or passageways (see, e.g., 144 in FIG. 2) that allow the refrigerant to be moved longitudinally (direction 136) through the flat tube 430. A first distal end 446 is in fluid communication with a chamber 448 of the third manifold 440 to allow refrigerant to pass into or from the chamber 448.

A first stepped portion 450 is formed on the first end 434 to provide a space for another laterally adjacent manifold to be placed as will be described further below. Outboard of the first stepped portion 450 is a manifold extension portion 451. The other end of the flat tube 430 is shown with a second distal end 452 in fluid communication with a chamber 454 to allow refrigerant to flow into or out of the chamber 454. A second stepped portion 456 is formed on the second end 444 to provide space for another laterally adjacent manifold to be placed, such as the manifolds 416. Outboard of the second stepped portion 456 is a manifold extension portion 457. The manifold extension portions provide a path for fluidly coupling to a manifold. The manifold extension portions may continue the microchannels on that portion or have a larger conduit portion.

Figure 14:
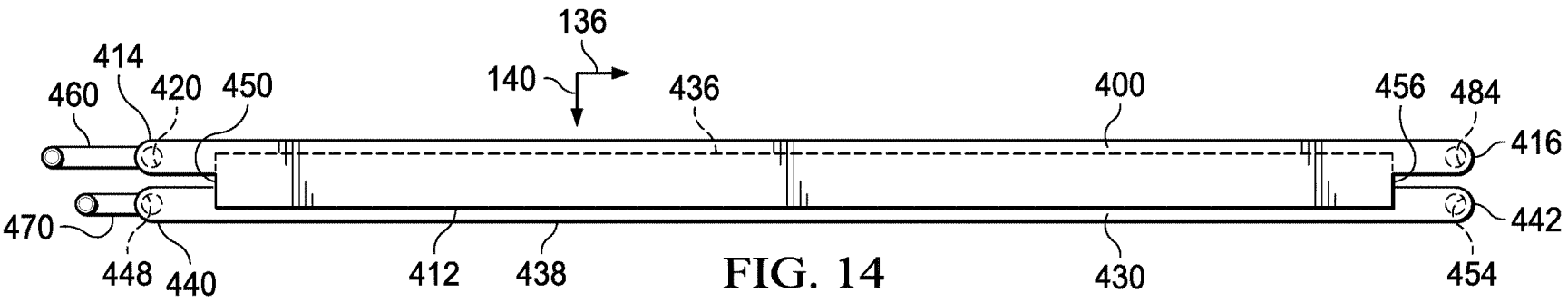
FIG. 14 is a schematic, top view of a multistage, microchannel condenser according to an illustrative embodiment.

The first plurality of flat tubes 402 and the second plurality of flat tubes 432 may be combined in various patterns, such as alternating, to intersperse the first plurality of flat tubes 402 and the second plurality of flat tubes 432. In doing this, the manifolds do not interfere and two closed refrigerant circuits exist. FIG. 14 shows a top view of how this would look in one embodiment. In this view, the first flat tube 400 of a first plurality of flat tubes 402 is shown over the second flat tube 430 of the second plurality of flat tubes 432—for illustration purposes flat tube 400 is shown with a slightly smaller width than the second flat tube 430, but it should be understood that they may be the same width (lateral direction 140).

Figure 15:
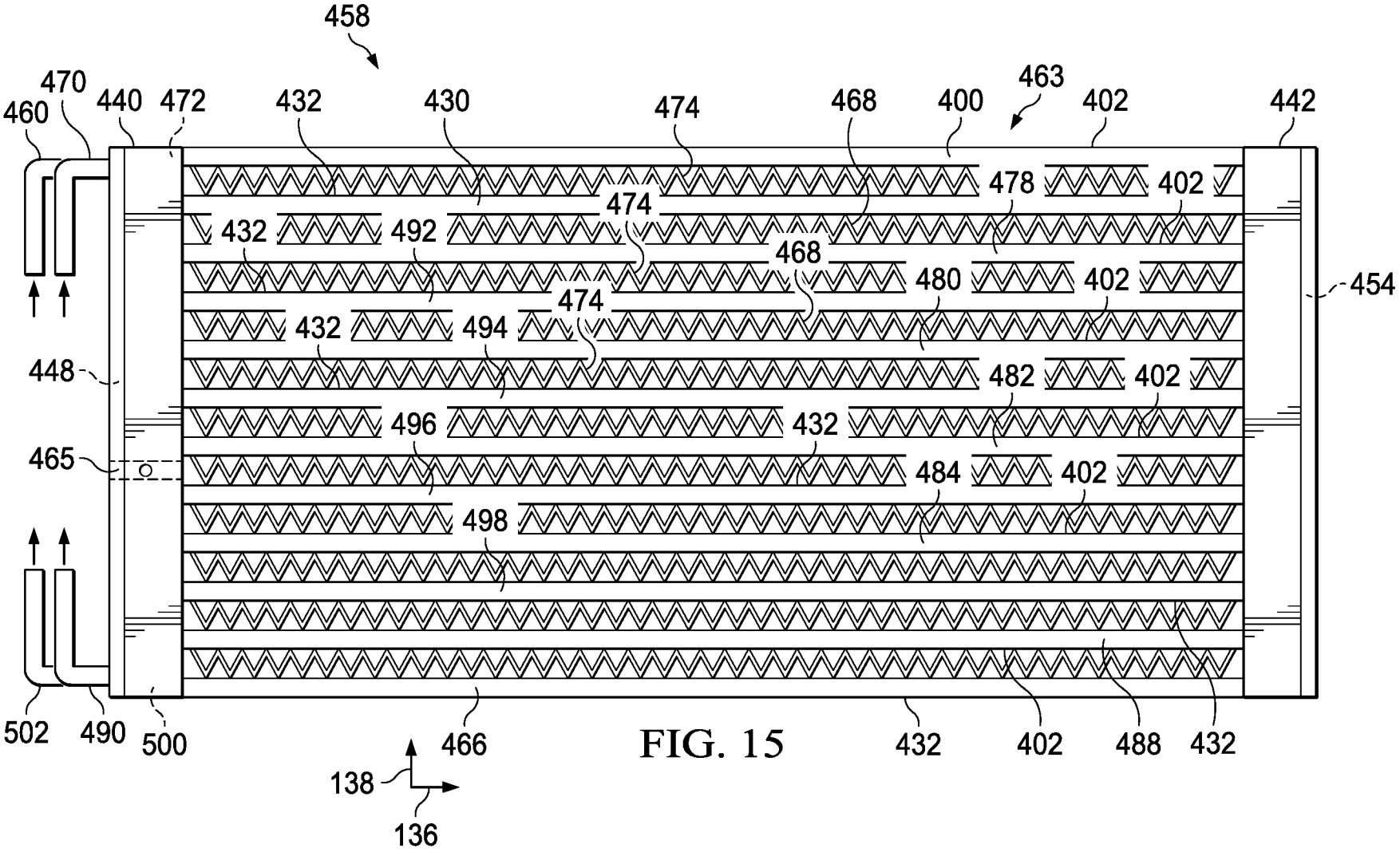
FIG. 15 is a schematic, front elevation view of the illustrative embodiment of the multistage, microchannel condenser of FIG. 14.
Figure 16:
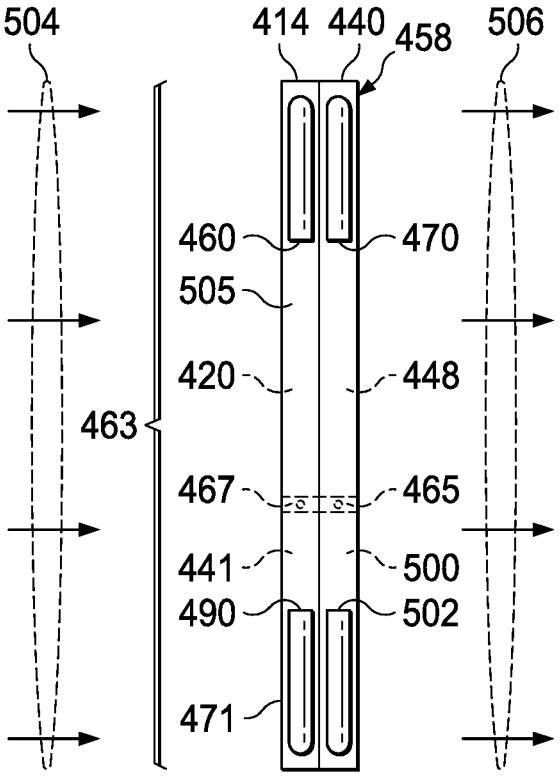
FIG. 16 is a schematic, side elevation view of the multistage, microchannel condenser of FIG. 14.

Referring now primarily to FIGS. 14 and 15, a multistage microchannel condenser 458 formed with the first plurality of flat tubes 402 and second plurality of flat tubes 432 is presented. A first refrigerant is delivered as an aspect of a first closed refrigeration circuit (see, e.g., 102 in FIG. 1) to a first inlet 460, which delivers the first refrigerant to a first chamber 420 in the first manifold 414 above a baffling member (analogous to baffling member 465 in the third manifold 440). The first plurality of flat tubes 402 extends in a first direction 136 between the first manifold 414 and the second manifold 416, which is across an exchange profile 463 defined by the inner edge of the first and third manifolds 414, 440 and the second and fourth manifolds 416, 442 and the top flat tube 400 (for the orientation shown in FIG. 15) and bottom flat tube (for the orientation shown in FIG. 15). The exchange profile 463 has an exchange area therein on the front face 471 (FIG. 16). As previously referenced, the first plurality of flat tubes 402 is fluidly coupled to the first chamber 420 of the first manifold 414 and to the second manifold 416. A first plurality of fins 468 may be attached to the first plurality of flat tubes 402, which are shown on top for the orientation presented except for the top one 400. A first plurality of fins 468 may be attached to the first plurality of flat tubes 402, which are shown on top for the orientation presented except for the top one 400.

A second refrigerant is delivered as an aspect of a second closed refrigeration circuit (see, e.g., 104 in FIG. 1) to second inlet 470 from where the second refrigerant is introduced into the chamber 448 (intake manifold) of the third manifold 440. As previously mentioned, the second plurality of flat tubes 432 extend in the second direction 136 between the third manifold 440 and the fourth manifold 442. The second plurality of flat tubes 432 are fluidly coupled to the third manifold 440 and the fourth manifold 442 for longitudinally transporting the second refrigerant therebetween. A second plurality of fins 474 may be coupled to the second plurality of tubes 432, for example, on a top surface for the orientation shown in in FIG. 15.

Again, while the first plurality of flat tubes 402 is interspersed with the second plurality of flat tubes 432 in an alternating pattern over the exchange area, it should be understood that other patterns might be used such as varying the alternating number, twists, and designs.

Referring now primarily to FIG. 16, an end view of the multistage microchannel condenser 458 is presented. In this view, the side by side nature of the first manifold 414 and the third manifold 440 is apparent. Moreover, a baffling member 467 is shown in hidden lines and shows how the first manifold 414 is partitioned to form the first chamber 420 and a second chamber 441. These two chambers 420, 441 function analogously to chambers 316 and 318 of FIG. 5. In FIG. 16, one may also see how a baffling member 465 partitions the third manifold 440 into the first chamber 448 and the second chamber 500, which function analogously to chambers 354 and 356 of FIG. 5. Chamber 426 of the second manifold 416 functions analogously to manifold 326 of FIG. 5. Likewise, chamber 454 of the fourth manifold 442 functions like manifold 366 of FIG. 5.

Flat tubes 400, 478, 480, 482 are fluidly coupled to the first chamber 420 of the first manifold 414. Flat tubes 484 and 488 are fluidly coupled to the second chamber 441 of the first manifold 414. Flat tubes 430, 492, 494 are fluidly coupled to the first chamber 448 of the third manifold 440. Flat tubes 496, 498, and 466 are fluidly coupled to the second chamber 500 of the third manifold 440. In this embodiment, chambers 420 and 448 are both intake chambers for the first refrigeration circuit and the second refrigeration circuit, respectively, and chambers 441 and 500 are outtake chambers for the first refrigeration circuit and the second refrigeration circuit, respectively. The chambers 426 and 454 are turn around or return chambers.

In operation according to one illustrative embodiment, the first refrigerant enters the inlet 460 and enters a first chamber 420 (FIGS. 14, 16) of the first manifold 414 (intake manifold) formed above (for orientation shown in FIG. 15) the baffling member 467 (FIG. 16). From there, the first refrigerant flows from that chamber 420 into flat tubes 400, 478, 480, 482 and across the flat tubes 400, 478, 480, 482 to second manifold 416 where the first refrigerant enters chamber 426 of the second manifold 416 (return manifold). From chamber 426, the first refrigerant is delivered to flat tubes 484, 488 (FIG. 15) and from there through the flat tubes 484, 488 to the second chamber 441 (FIG. 16) in the first manifold 414 and then out through outlet 490 to other portions of the first closed refrigeration circuit.

Likewise, the second refrigerant from the second refrigeration circuit (e.g., 104 in FIG. 1) enters the second inlet 470 and enters the chamber 448 (intake manifold) from where the second refrigerant is delivered to flat tubes 430, 492, 494, and then into chamber 454 of the fourth manifold 442 (return manifold). From there, the second refrigerant is delivered to flat tubes 496, 466, and 498 and then through the flat tubes 496, 466, and 498 to the second chamber 500 (FIGS. 15 and 16) of the third manifold 440 and then exits through an outlet 502. As shown best in FIG. 14, the first manifold 414 and third manifold 440 are laterally displaced (along direction 140) but aligned, or parallel, in the longitudinal direction 136. Likewise, second manifold 416 and fourth manifold 442 are laterally displaced (along direction 140) but are aligned, or parallel, with respect to the longitudinal direction 136; in other words, while laterally spaced they end on a longitudinal reference side by side.

Referring now again primarily to FIG. 16, an elevation view from the front of the multistage microchannel condenser 458 is presented. Cooling air 504 is moved by the condenser blower (see 143 in FIG. 1) across the multistage microchannel condenser 458 to produce the discharge airflow 506. The cooling airflow 504 impinges on a front face 505 of the multistage microchannel condenser 458. The cooling airflow 504 is delivered over substantially all of the exchange profile 463, but the arrangement avoids any substantial thermal dead spaces or ineffective areas even when only one of the closed refrigeration circuits is operative because the first plurality of flat tubes 402 and the second plurality of flat tubes 432 is interspersed throughout the exchange area. Moreover, the footprint of the multistage microchannel condenser 458 is not increased since the manifolds are side by side on each end.

Figure 17:
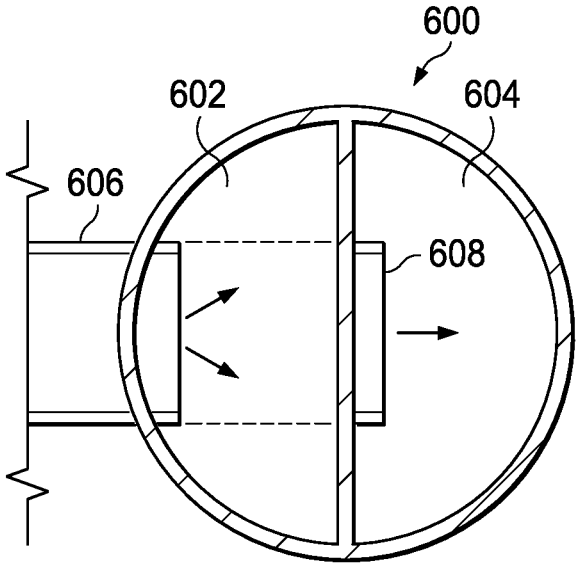
FIG. 17 is a schematic, cross sectional view of a manifold having two parallel chambers extending through the manifold's length.

The illustrative embodiments presented are not intended to be limiting and variations may be made in other embodiments. For example, instead of two manifolds on each end, there may be a single manifold 600 with multiple chambers 602, 604 as shown in FIG. 17. In this example, a first flat tube 606 is shown entering and terminating in a first chamber 602 and below it a second flat tube 608 traverses the first chamber 602 and remains sealed from the first chamber 602 and terminates in a second chamber 604. Because they are analogous, the first chamber 602 may be referred to as a first manifold and the second chamber 604 may be referred to as a second manifold herein.

Referring now primarily to FIGS. 5 and 15, it will appreciated that both of the multistage microchannel condensers 300 and 458 include at least two pluralities of flat tubes 320, 360, 402, 432 interspersed in an exchange area. The multistage microchannel condensers 300 and 458 include a first first-end manifold 306, 414 having long dimension at a right angle to a long dimension of the at least two pluralities of flat tubes 320, 360, 402, 432 and wherein the first first-end manifold 306, 414 is disposed proximate a first end of the multistage microchannel condenser 300, 458 and a second first-end manifold 366, 440 having long dimension at a right angle to a long dimension of the at least two pluralities of flat tubes 320, 360, 402, 432 and wherein the second first-end manifold 366, 440 is disposed proximate a first end of the multistage microchannel condenser 366, 440.

The multistage microchannel condensers 300 and 458 further includes a first second-end manifold 326, 416 having long dimension at a right angle to the long dimension of the at least two pluralities of flat tubes 320, 360, 402, 432 and wherein the first second-end manifold 326, 416 is disposed proximate a second end of the multistage microchannel condenser. The multistage microchannel condensers 300 and 458 further includes a second second-end manifold 350, 442 having long dimension at a right angle to the long dimension of the at least two pluralities of flat tubes 320, 360, 402, 432 and wherein the second second-end manifold 350, 442 is disposed proximate a second end of the multistage microchannel condenser 300, 458. The first end of the first plurality of flat tubes 320, 402 is fluidly coupled to the first first-end manifold 306, 414 for intake and the second end of the first plurality of flat tubes 320, 402 is fluidly coupled to the first second-end manifold 326, 416. The first end of the second plurality of flat tubes 360, 432 is fluidly coupled to the second first-end manifold 366, 440 and the second end of the second plurality of flat tubes 360, 432 is fluidly coupled to the second second-end manifold 350, 442.

In one illustrative embodiment (FIGS. 5-11), the first first-end manifold 306 and the second first-end manifold 366 are longitudinally displaced from one another in a direction (direction 136) parallel to the long dimension of the two pluralities of flat tubes 320, 360. In another illustrative embodiment (FIGS. 12-15), the first first-end manifold 414 and the second first-end manifold 440 are laterally displaced from one another in a direction (out of page for FIG. 15) orthogonal to the long dimension of the two pluralities of flat tubes 402, 432 and substantially adjacent to one another with respect to the direction (direction 140; see FIG. 14) of the long dimension of the two pluralities of flat tubes 402, 432.

According to one illustrative embodiment, a multistage microchannel condenser for use in a heating, ventilating, and air conditioning (HVAC) system includes a first plurality of flat tubes having a first end and a second end, the first plurality of flat tubes for receiving and transporting the first refrigerant, each flat tube of the first plurality of flat tubes having a plurality of microchannels and in fluid communication with the first closed refrigeration circuit, the first plurality of flat tubes extending in a first, longitudinal direction; a second plurality of flat tubes having a first end and a second end, the second plurality of flat tubes for receiving and transporting the second refrigerant, each flat tube of the second plurality of flat tubes having a plurality of microchannels and in fluid communication with the second closed refrigeration circuit, the second plurality of flat tubes extending in the first, longitudinal direction; wherein at least a portion of the first plurality of flat tubes is interspersed with at least a portion of the second plurality of flat tubes throughout at least a majority of the exchange area; a first manifold fluidly coupled to the first plurality of flat tubes at the first end of the first plurality of flat tubes, and the first manifold extending with respect to its long dimension in a second, vertical direction that is substantially orthogonal to the first, longitudinal direction; a second manifold fluidly coupled to the first plurality of flat tubes at the second end of the first plurality of flat tubes and extending with respect to its long dimension in the second, vertical direction; a third manifold fluidly coupled to the second plurality of flat tubes at the first end of the second plurality of flat tubes and the third manifold extending with respect to its long dimension in the second, vertical direction; a fourth manifold fluidly coupled to the second plurality of flat tubes at the second end of the second plurality of flat tubes and the fourth manifold extending with respect to its long dimension in the second, vertical direction; and wherein the first manifold and third manifold are parallel to one another and displaced from one another along a third, lateral direction substantially orthogonal to the first direction and second direction.

According to another illustrative embodiment, a method for cooling air using a heating, ventilating, and air conditioning (HVAC) system includes: circulating a first refrigerant through a first closed refrigerant circuit; circulating a second refrigerant through a second closed refrigerant circuit; while keep the first refrigerant and second refrigerant separated, cooling the first refrigerant and the second refrigerant in a multistage microchannel condenser. The step of cooling the first refrigerant and second refrigerant comprises: flowing the first refrigerant into a first manifold of the multistage microchannel condenser and into a first portion of a first plurality of flat tubes and into a second manifold of the multistage microchannel condenser and returning the first refrigerant to a portion of the first manifold through another portion of the first plurality of flat tubes; flowing the second refrigerant into a third manifold of the multistage microchannel condenser and into a first portion of a second plurality of flat tubes and into a fourth manifold of the multistage microchannel condenser and returning the second refrigerant to a portion of the third manifold through another portion of the second plurality of flat tubes; wherein the first plurality of flat tubes and the second plurality of flat tubes are at least partially interspersed; and wherein two of the first manifold, the second manifold, the third manifold, and the fourth manifold are disposed on a first end of the multistage microchannel condenser and are displaced from one another either longitudinally or laterally. In a further embodiment, a different two of the first manifold, the second manifold, the third manifold, and the fourth manifold are disposed on a second end of the multistage microchannel condenser and are displaced from one another either longitudinally or laterally.

In some illustrative embodiments, the enhanced efficiency given that the heat exchange takes place over all the exchange area may allow the condenser blower to be operated at a slower speed and still produce the same results as a current system. In some embodiments, the heat exchangers herein may be used in other HVAC components (other than condensers) requiring heat transfer and having a need for partial and full loads at different times.

In the detailed description of the preferred embodiments herein, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The detailed description herein is, therefore, not to be taken in a limiting sense, and the scope of the present invention is defined only by the claims. Unless otherwise indicated, as used throughout this document, "or" does not require mutual exclusivity.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment. Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed is:

1. A heating, ventilating, and air conditioning (HVAC) system comprising:

a first closed refrigeration circuit comprising:

a first compressor, a condenser fluidly coupled to the first compressor, a first expansion device fluidly coupled to the condenser, a first evaporator fluidly coupled to the first expansion device and to a suction side of the first compressor, and a first refrigerant;

a second closed refrigeration circuit comprising:

a second compressor, the condenser fluidly coupled to the second compressor, a second expansion device fluidly coupled to the condenser, a second evaporator fluidly coupled to the second expansion device and to a suction side of the second compressor, and a second refrigerant, wherein the first refrigerant and second refrigerant remain separated;

wherein the condenser comprises a multistage microchannel condenser having an exchange profile, wherein the exchange profile comprises an exchange area;

a condenser blower for producing a condenser airflow across the multistage microchannel condenser; and wherein the multistage microchannel condenser comprises:

a first plurality of flat tubes having a first end and a second end, the first plurality of flat tubes for receiving and transporting the first refrigerant, each flat tube of the first plurality of flat tubes having a plurality of microchannels and in fluid communication with the first closed refrigeration circuit, the first plurality of flat tubes extending in a first, longitudinal direction, wherein each of the first plurality of flat tubes has a manifold extension portion formed at the first end and second end that extends in a third, lateral direction a portion of a width of the flat tube of the first plurality of flat tubes, a second plurality of flat tubes having a first end and a second end, the second plurality of flat tubes for receiving and transporting the second refrigerant, each flat tube of the second plurality of flat tubes having a plurality of microchannels and in fluid communication with the second closed refrigeration circuit, the second plurality of flat tubes extending in the first, longitudinal direction, wherein at least a portion of the first plurality of flat tubes is interspersed with at least a portion of the second plurality of flat tubes throughout at least a majority of the exchange area, a first manifold fluidly coupled to the first plurality of flat tubes at the first end of the first plurality of flat tubes, and the first manifold extending in a second, vertical direction that is substantially orthogonal to the first, longitudinal direction, a second manifold fluidly coupled to the first plurality of flat tubes at the second end of the first plurality of flat tubes and extending in the second, vertical direction, a third manifold fluidly coupled to the second plurality of flat tubes at the first end of the second plurality of flat tubes and the third manifold extending in the second, vertical direction, a fourth manifold fluidly coupled to the second plurality of flat tubes at the second end of the second plurality of flat tubes and the fourth manifold extending in the second, vertical direction, and wherein the first manifold and third manifold are parallel to one another and displaced from one another along the third, lateral direction substantially orthogonal to the first direction and second direction.

2. The system of claim 1, wherein the first manifold has a baffling member therein that forms a first chamber and a second chamber.

3. The system of claim 1, wherein the third manifold has a baffling member therein that forms a third chamber and a fourth chamber.

4. The system of claim 1, wherein each of the second plurality of flat tubes has a manifold extension portion formed at the first end and second end that each extends in the third, lateral direction a portion of a width of the flat tube of the second plurality of flat tubes.

5. The system of claim 1, wherein the manifold extension portion formed at the first end and second end of each of the first plurality of flat tubes extends in the third direction less than half a width of the flat tube and extends away from a first longitudinal edge of the flat tube, and wherein each of the second plurality of flat tubes has a manifold extension portion formed at the first end and second end that extends in the third, lateral direction less than half a width of the flat tube and extends away from a second longitudinal edge of the flat tube.

6. The system of claim 1, wherein each of first plurality of flat tubes has the first manifold extension portion formed at the first end and second end that extends in the third, lateral direction a portion of the flat tube and extends away from a first longitudinal edge of the flat tube to form a stepped portion to provide a space for another laterally adjacent manifold to be placed, and wherein each of the second plurality of flat tubes has a second manifold extension portion formed at the first end and second end that extends in the third, lateral direction a portion of the flat tube and extends away from a second longitudinal edge of the flat tube to form a second stepped portion to provide a space for another laterally adjacent manifold to be placed.

7. The system of claim 1, where the first plurality of flat tubes has a longitudinal dimension that is equal to a longitudinal dimension of the second plurality of flat tubes.

8. A heating, ventilating, and air conditioning (HVAC) system comprising:

at least two closed refrigerant circuits;

a multistage microchannel condenser having an exchange area and having at least two pluralities of flat tubes interspersed in the exchange area, wherein the at least two closed refrigerant circuits are fluidly coupled to the multistage microchannel condenser;

at least two manifolds at a first longitudinal end of the at least two pluralities of flat tubes and on a first end of the multistage microchannel condenser, wherein the at least two manifolds at the first longitudinal end are laterally displaced from one another in a direction orthogonal to a length of the two pluralities of flat tubes;

at least two manifolds at a second longitudinal end of the at least two pluralities of flat tubes and on a second end of the multistage microchannel condenser, wherein the at least two manifolds at the second longitudinal end are laterally displaced from one another in a direction orthogonal to the length of the two pluralities of flat tubes; and wherein at least one of the plurality of flat tubes has a manifold extension portion formed at a first end and a second end that extends in a lateral direction a portion of a width of the flat tube of the at least one of plurality of flat tubes.

9. An heating, ventilating, and air conditioning (HVAC) system comprising:

at least two closed refrigerant circuits;

a multistage microchannel condenser having an exchange area and having a first plurality of flat tubes and a second plurality of flat tubes interspersed in the exchange area, wherein the at least two closed refrigerant circuits are fluidly coupled to the multistage microchannel condenser;

wherein each of the first plurality of flat tubes has a manifold extension portion formed at the first end and second end that extends in a lateral direction a portion of a width of the flat tube of the first plurality of flat tubes;

a first first-end manifold having long dimension at a right angle to a long dimension of the first plurality of flat tubes and wherein the first first-end manifold is disposed proximate a first end of the multistage microchannel condenser;

a second first-end manifold having long dimension at a right angle to a long dimension of the first plurality of flat tubes and wherein the second first-end manifold is disposed proximate the first end of the multistage microchannel condenser;

a first second-end manifold having long dimension at a right angle to the long dimension of the first plurality of flat tubes and wherein the first second-end manifold is disposed proximate a second end of the multistage microchannel condenser;

a second second-end manifold having long dimension at a right angle to the long dimension of the first plurality of flat tubes and wherein the second second-end manifold is disposed proximate a second end of the multistage microchannel condenser;

wherein a first end of the first plurality of flat tubes is fluidly coupled to the first first-end manifold and a second end of the first plurality of flat tubes is fluidly coupled to the first second-end manifold;

wherein a first end of the second plurality of flat tubes is fluidly coupled to the second first-end manifold and a second end of the second plurality of flat tubes is fluidly coupled to the second second-end manifold; and wherein the first first-end manifold and the second first-end manifold are laterally displaced from one another in a direction orthogonal to the long dimension of the first plurality of flat tubes and substantially adjacent to one another with respect to the direction of the long dimension of the first plurality of flat tubes.

* * * * *